United States Patent [19]

Heinemann et al.

[11] Patent Number: 4,880,172

[45] Date of Patent: Nov. 14, 1989

[54] ROLLER MILL

[75] Inventors: Otto Heinemann, Ennigerloh; Heinz-Dieter Baldus, Ahlen; Norbert Schröder, Oelde, all of Fed. Rep. of Germany

[73] Assignee: Krupp Polysius AG, Fed. Rep. of Germany

[21] Appl. No.: 155,577

[22] Filed: Feb. 12, 1988

[30] Foreign Application Priority Data

Mar. 5, 1987 [DE] Fed. Rep. of Germany ..... 3707015

[51] Int. Cl.[4] ..... B02C 4/02; B02C 4/32

[52] U.S. Cl. ..... 241/101.2; 241/231

[58] Field of Search ..... 241/101.2, 230, 231, 241/232, 233

[56] References Cited

U.S. PATENT DOCUMENTS 3,587,986 6/1971 Alciati ..... 241/231

3,700,182 10/1972 Dediemar et al. ..... 241/230

*Primary Examiner*—Timothy V. Eley

*Attorney, Agent, or Firm*—Learman & McCulloch

[57] ABSTRACT

The invention relates to a roller mill with two rollers driven in opposite directions, in which the two gear driven cases are connected directly to one another by a torque support containing a flexible member.

4 Claims, 3 Drawing Sheets

ROLLER MILL

The invention relates to a roller mill for the comminution of brittle material such as cement clinker.

BACKGROUND OF THE INVENTION

In the previously known roller mills of the type to which the invention pertains the gear cases of the two rollers are each supported on the machine frame by a torque support. Because of the high torques which occur, these torque supports necessitate considerable expenditure on construction.

The object of the invention, therefore, is to construct a roller mill of the type referred to in such a way that the construction costs for the torque support are substantially reduced.

SUMMARY OF THE INVENTION

According to the invention the torques are almost completely supported against one another between the gear cases of the two rollers. Only any residual torque which might result from a possible difference in the two torques is supported on the machine frame by a simple torque support. In this way considerable savings are made in the machine construction.

THE DRAWINGS

One embodiment of the invention is illustrated in the drawings, in which.

DETAILED DESCRIPTION

Figure 1:
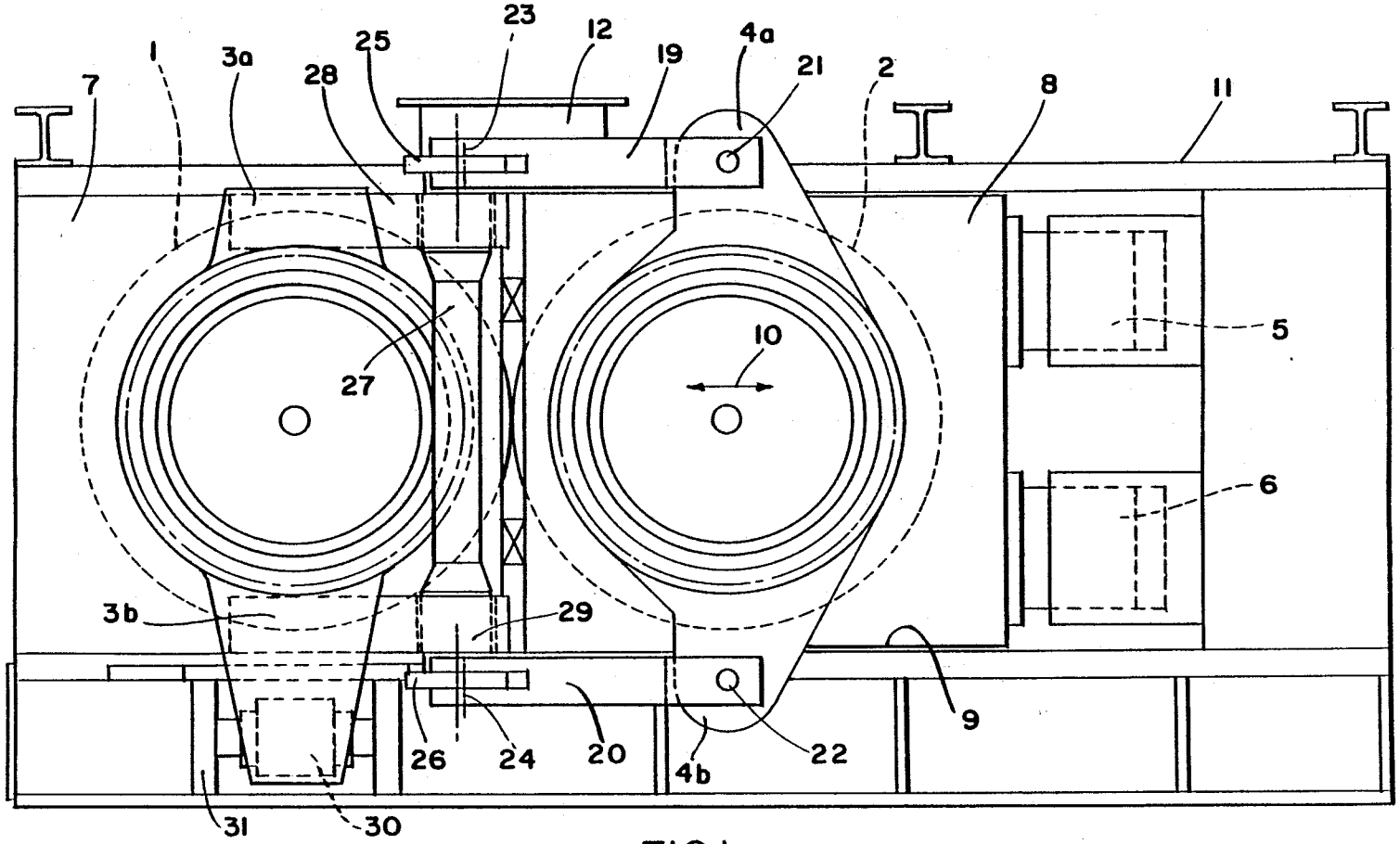
FIG. 1 shows a longitudinal section through the roller mill.

The illustrated roller mill is intended for example for the comminution of brittle material, such as cement clinker, and contains two rollers 1, 2 which are driven in opposite directions by gears 3, 4 and are pressed against one another with a high contact pressure by hydraulic cylinders 5, 6. The roller 1 is constructed as a fixed roller and arranged in a fixed bearing jewel 7, whilst the roller 2 is constructed as a floating bearing roller and arranged in a floating bearing jewel 8. The floating bearing jewel 8 which is acted upon by the hydraulic cylinders 5, 6 is slidable in a slide bearing 9 in the direction of the arrow 10.

The machine frame is designated by 11 and the feed shaft for the roller gap is designated by 12.

Figure 2:
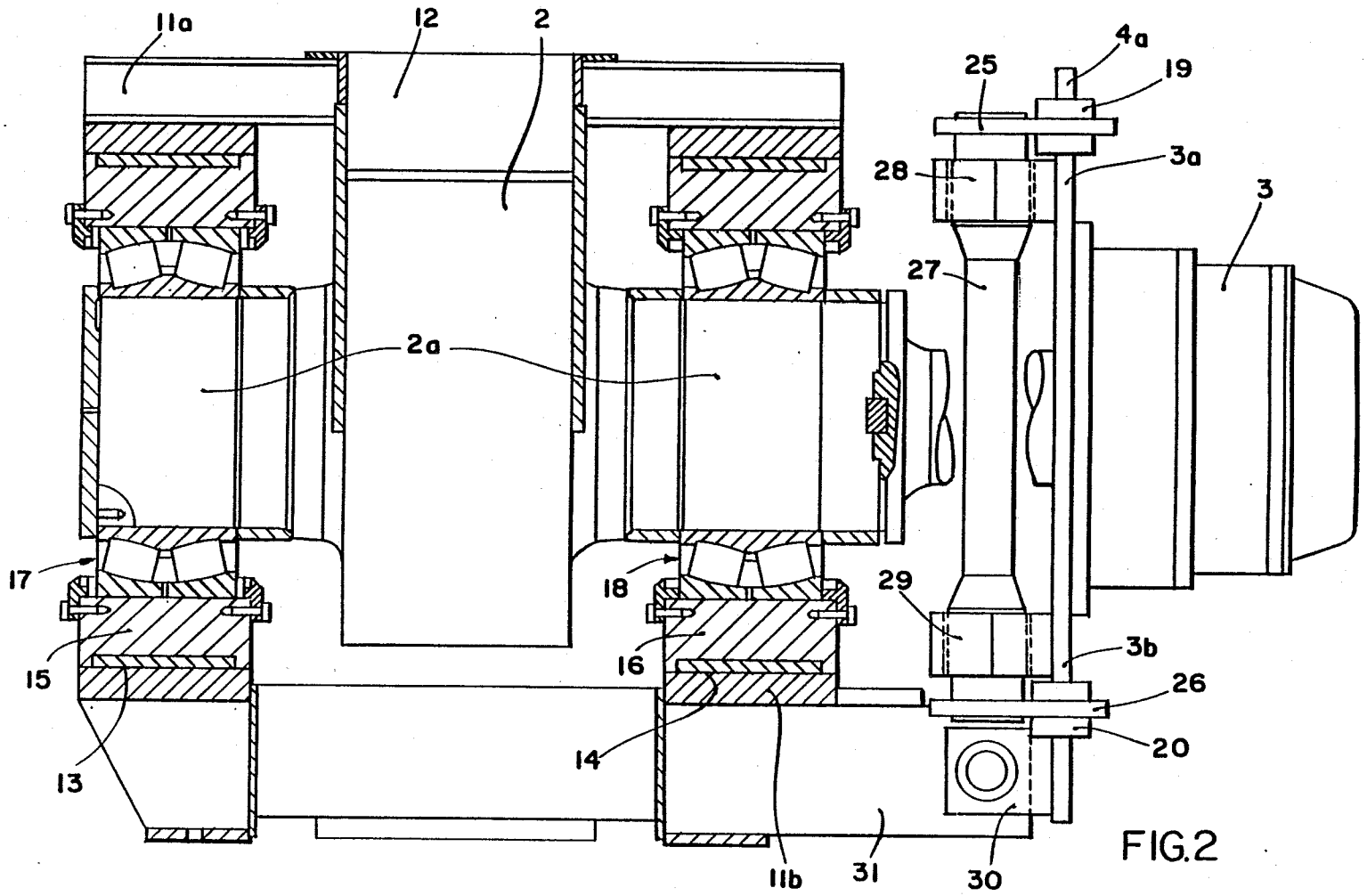
FIG. 2 shows a partially cut-away or broken cross-section.
Figure 3:
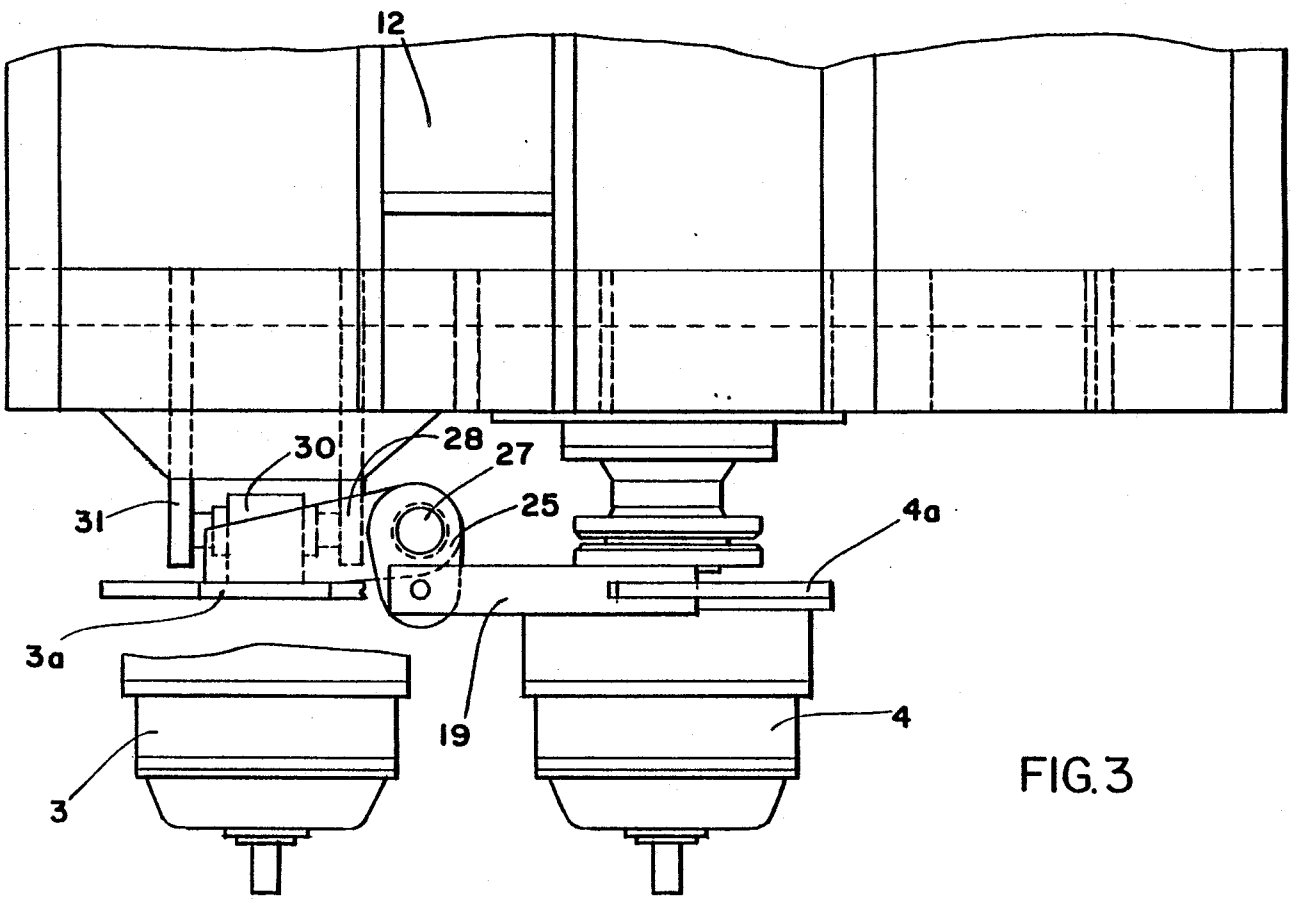
FIG. 3 shows a plan view of the parts of the roller mill which are essential to an understanding of the invention.

FIG. 2 shows the mounting of the floating roller 2 in detail: In the machine frame consisting of the upper frame 11*a* and the lower frame 11*b* two slide bearings 13, 14 for the outer bearing rings 15, 16 of the bearings 17, 18 are provided to receive the shaft 2*a* of the floating roller 2.

A torque support is provided between the two gears 3 and 4 to take up the principal torque in opposite directions exerted on the two rollers 1, 2. This torque support contains two couples 19, 20 which are flexibly connected on radially opposing sides of the floating roller shaft to projections 4*a*, 4*b* on the case of the gear 4 of the floating roller 2 by spindles 21, 22.

The couples 19, 20 are pivotably connected at their other, slotted ends to coupling levers 25, 26 by spindles 23, 24 running at right angles to the couples.

A coupling shaft 27 which is connected at both ends to the coupling levers 25, 26 so as to be fixed against rotation is constructed as a torsion bar and mounted in coupling shaft bearings 28, 29 which are connected on radially opposing sides of the fixed roller shaft to projections 3*a*, 3*b* on the case of the gear 3 of the fixed roller.

The torque support between the gears 3 and 4 as described above completely absorbs the contrarotating torque of the two rollers 1 and 2 which are driven in opposite directions. The coupling shaft 27 which is constructed as a torsion bar permits movement of the floating roller 2 (in the direction of the arrow 10) relative to the fixed roller 1.

Only a differential torque resulting from any difference in the torques needs to be supported on the machine frame 11. For this purpose the projection 3*b* on the gear 3 of the fixed roller 1 is extended downwards and is coupled to the frame 11 by support elements 30, 31.

We claim:

1. In a roller mill having a frame, a fixed roller mounted on said frame, a floating roller mounted on said frame for movements toward and away from said fixed roller, means for urging said floating roller into engagement with said fixed roller under high contact pressure, drive gearing contained in casings and coupled to the respective rollers for driving said rollers in opposite directions, and means for absorbing torque occuring between said gearing and said frame, the improvement wherein said torque absorbing means comprises first support means directly connecting said casings to one another for taking up contrarotating principal torque, and second support means connecting one of said casings to said frame for taking up differential torque, said first support means having a flexible member for accommodating relative movement between said rollers.

2. The roller mill according to claim 1 wherein said first support means comprises a torsion bar.

3. The roller mill according to claim 1 wherein said first support means comprises a pair of couples connected at corresponding ends to the casing of the floating roller at radially opposing sides thereof, a pair of coupling levers connected to said couples at the opposite ends thereof for pivotal movement at right angles to said couples, a coupling shaft connected at both ends to the coupling levers so as to be fixed against rotation and form a torsion bar, and a pair of coupling shaft bearings connected to the casing of the fixed roller on radially opposing sides thereof.

4. The roller mill according to claim 1 wherein said second support means comprises an extension fixed to the casing of said fixed roller and connected to said frame.

* * * * *

UNITED STATES PATENT AND TRADEMARK OFFICE

CERTIFICATE OF CORRECTION

PATENT NO. : 4,880,172

DATED : November 14, 1989

INVENTOR(S) : Heinemann et al

It is certified that error appears in the above-identified patent and that said Letters Patent is hereby corrected as shown below:

ON TITLE PAGE:

In line 1 of the "ABSTRACT", after "two" insert -- gear driven --; line 3 cancel "driven".

Signed and Sealed this

Third Day of December, 1991

*Attest:*

HARRY F. MANBECK, JR.

*Attesting Officer*

*Commissioner of Patents and Trademarks*